United States Patent [19]

Larson

[11] Patent Number: 4,626,007

[45] Date of Patent: Dec. 2, 1986

[54] TILT BOLT LOCK

[75] Inventor: Wayne F. Larson, Salem, Oreg.

[73] Assignee: Supra Products, Inc., Salem, Oreg.

[21] Appl. No.: 637,521

[22] Filed: Aug. 3, 1984

[51] Int. Cl.[4] ..... E05C 5/02

[52] U.S. Cl. ..... 292/65; 292/DIG. 22

[58] Field of Search ..... 292/346, 65, 64, 67, 292/5, 169.13, 191, 192, DIG. 22; 70/416, 418, 302, 63, 316

[56] References Cited

U.S. PATENT DOCUMENTS

| | | | |
|---|---|---|---|
| 1,492,088 | 4/1924 | Schmitz | 292/65 X |
| 3,751,949 | 8/1973 | Castle | 292/65 X |
| 3,800,576 | 4/1974 | Barrett et al. | 70/63 X |

*Primary Examiner*—Richard E. Moore

*Attorney, Agent, or Firm*—Klarquist, Sparkman, Campbell, Leigh & Whinston

[57] ABSTRACT

A lock in which a closure structure carries a cammable latch bolt which is spring urged toward a latching position. Stops are provided on the latch bolt and on a member carrying the latch bolt to normally prevent retracting movement of the latch bolt under inertia forces. The latch bolt is mounted for movement in a direction to displace the stops out of a registering position to permit camming of the latch bolt toward a releasing position during closing movement of the closing structure.

5 Claims, 5 Drawing Figures

TILT BOLT LOCK

This invention relates to a combination lock particularly suitable for key safe purposes but can be used elsewhere.

The prior patent of Iral D. Barrett, U.S. Pat. No. 3,800,576 entitled "Combination Lock" issued Apr. 2, 1974, shows a combination lock for use in connection with a key safe. The arrangement is such that the combination lock is mounted on a door or closure (hereinafter "door") for a box containing the key. When the combination is operated properly, a latch bolt can be manually moved downwardly to a releasing position against the resistance of internal springs.

Since security is of utmost importance, a key safe is made of rugged construction and the door is made such that it cannot be tampered with, and while it may not be adsolutely tamper-proof, it is close to it.

It has been discovered that unscrupulous persons have found a way of opening a certain number of the lock boxes by pounding them in a direction such that the inertia of the latching bolt will move it downwardly against the internal spring pressure to unlatch the door to provide access to the house key.

The present invention is directed toward eliminating the above possibility by providing a stop arrangement which prevents the latch bolt from moving downwardly even under the above circumstances. However, the stop arrangement is also so designed that when inserting the door in place, the latch bolt may be cammed downwardly against the internal spring pressure, past a retaining element, whereafter the latch bolt automatically moves to a latching position. Thereafter the stop arrangement comes into play to prevent downward movement of the latch bolt, except under the influence of manual pressure applied to the release button, and that can effectively occur only when the proper combination is entered into the lock.

More particularly, in the specific embodiment of the invention disclosed, the latch bolt is arranged so that its camming action on a locking flange, during closing movement of the door, tilts the bolt away from a stop that would otherwise prohibit its retracting movement, enabling such camming action to move the latch bolt in a retracting direction, against the resistance of the internal springs. After the latch bolt passes the locking flange, it is permitted to snap toward a locking position behind such flange under the urgence of the internal spring arrangement.

The main object of the invention is to provide an improved lock structure of the spring pressed latch bolt type, wherein a stop arrangement is provided that prevents unlocking inertial movement of the latch bolt in the closed position of the lock arrangement, but permits the latch bolt to be moved in a retracting or unlocking direction during closing movement of the closure member and under a camming contact of the latch bolt upon engagement with other structure of the lock.

Various other objects of the invention will be apparent from the following description taken in connection with the accompanying drawings wherein.

DESCRIPTION OF PREFERRED EMBODIMENT

Figure 1:
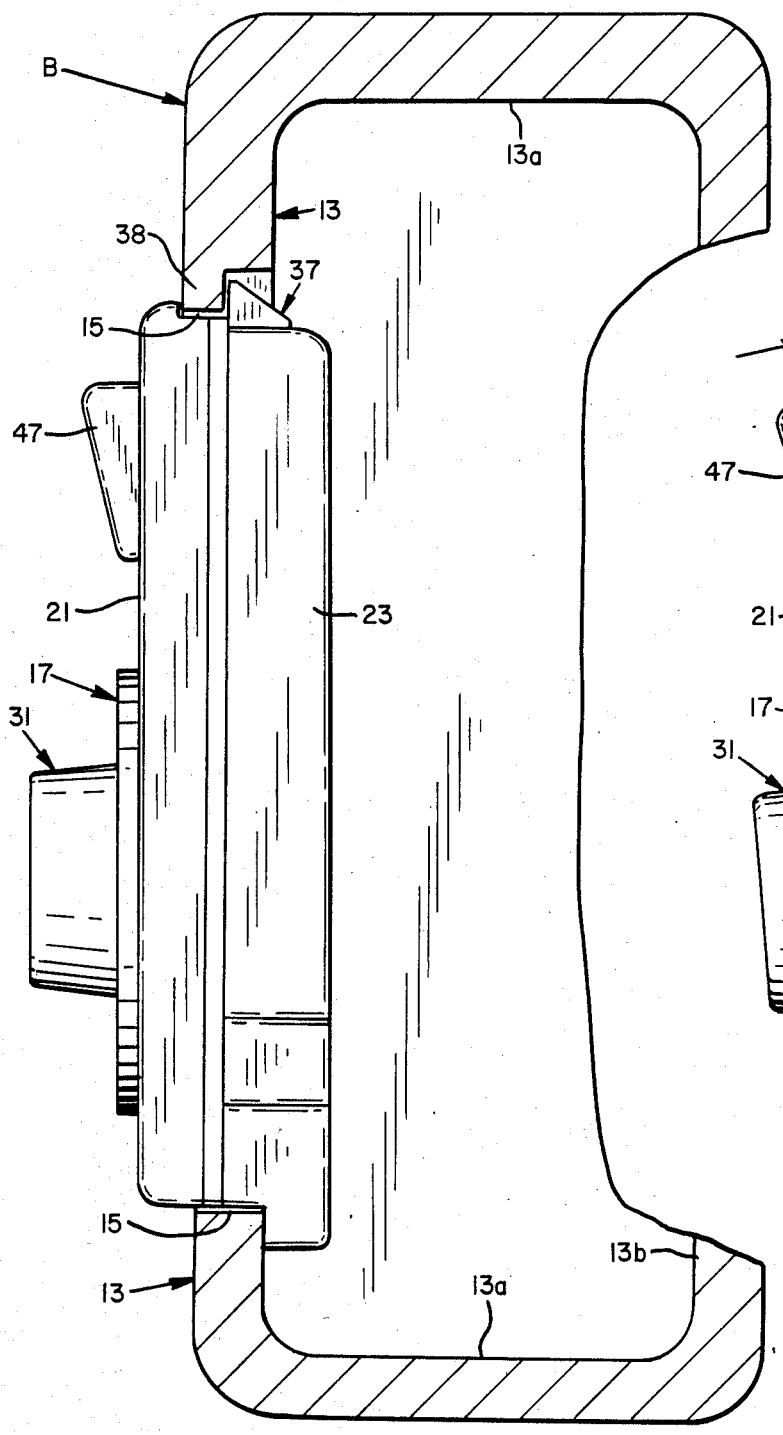
FIG. 1 is a vertical sectional view through a lock box embodying the concepts of the present invention and showing the door in its closed, locked condition.
Figure 2:
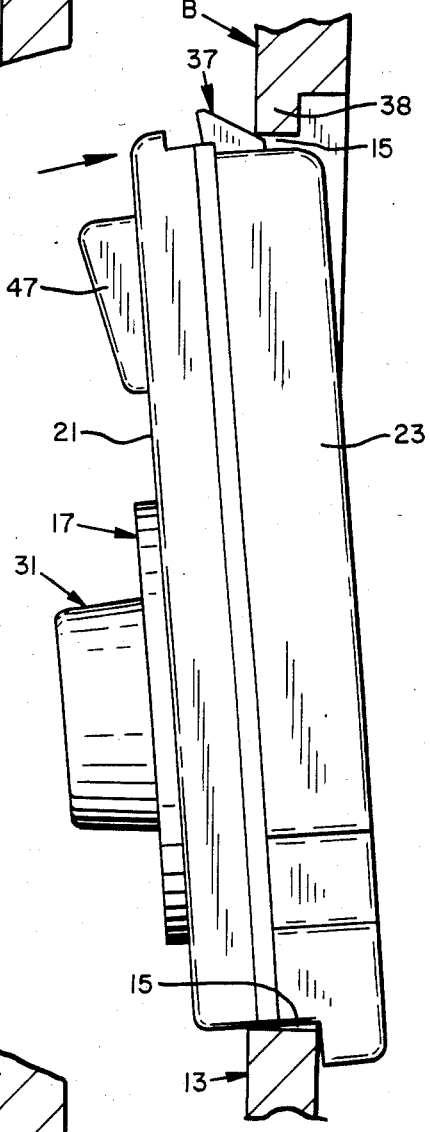
FIG. 2 is a view like FIG. 1, but showing the door open, but in the process of being moved to its closed, locked position.

The accompanyng drawings show, in general terms, a key safe or lock box B of the type referred to in prior U.S. Pat. No. 3,800,576. The box has a front wall 13, peripheral walls 13*a* and a rear wall 13*b*. The front wall is formed with a generally rectangular opening 15 normally closed by a door D. The door has a case conveniently made of two parts, a front housing member 21 and a rear housing member 23 detachably secured together by screws (not shown).

The case is internally recessed to accommodate a combination lock assembly generally indicated by the reference numeral 31 like that of the above mentioned patent. In fact, much of the internal structure of the lock is identical to that in U.S. Pat. No. 3,800,576. To avoid distracting from which is new in the present invention, only so much of the internal components of the present lock box are shown and will be described as are necessary for an understanding of the present invention. It follows that the internal components of the door of the present invention will be assumed to be like that in said patent unless otherwise stated.

Figure 5:
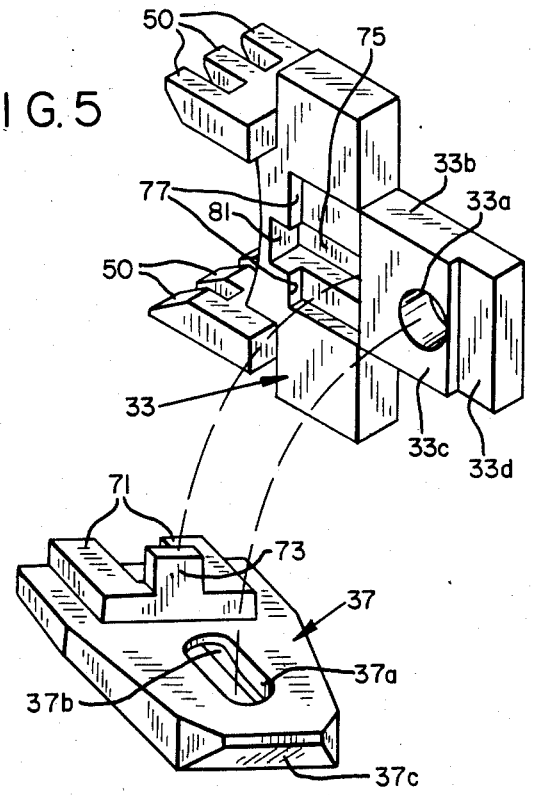
FIG. 5 is an exploded view of the yoke and latch bolt to better show their relationship.

A slide generally entitled 33, in the form of a yoke (FIGS. 3 and 5) cooperates with the combination wheels so that stops 50 (FIG. 5) on each side of the yoke are disposed in close proximity to the peripheries of the three combination wheels, to normally prevent retracting sliding movement of the slide. However, when the wheels are turned so that notches (not shown) in them coincide with the stops 50, the slide 33 can be moved retroactively (downwardly). It is urged upwardly by a spring arrangement (not shown) but disclosed in U.S. Pat. No. 3,800,576.

There is a latch bolt 37 for latching engagement with a lip or flange 38 formed on the front housing member 21. The latch bolt is formed with a vertically elongated slot 37*a*, and coil compression springs 39 urge the latch bolt upwardly to its FIG. 3 position. The slot 37*a* receives a reduced portion of a retract shaft 41.

The retract shaft 41 (FIG. 3) has a manual contact button 47 on its outer end, the shaft projecting through a slot 49 formed in front housing member 21, and passing through a bore 33*a* (FIG. 5) formed in an upwardly projecting portion 33*b* of the slide 33.

A screw 61 (FIG. 3) threads into the inner and of the retract shaft 41 to retain a coil compression spring 63 in position in a recessed portion 37*b* of the latch bolt 37. The spring urges the latch bolt to assume a flush position with a rear face portion 33*c* of the yoke portion 33*b* (compare FIGS. 1 and 3).

Figure 3:
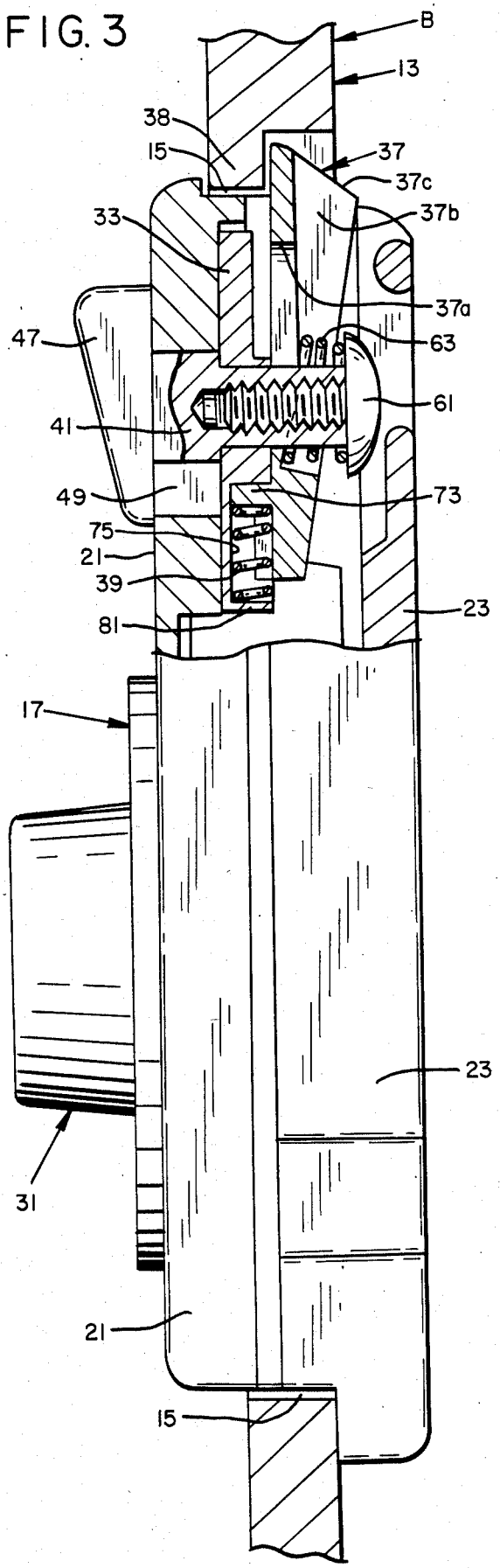
FIG. 3 is an enlargement of a portion of FIG. 1 to better show the details of construction.
Figure 4:
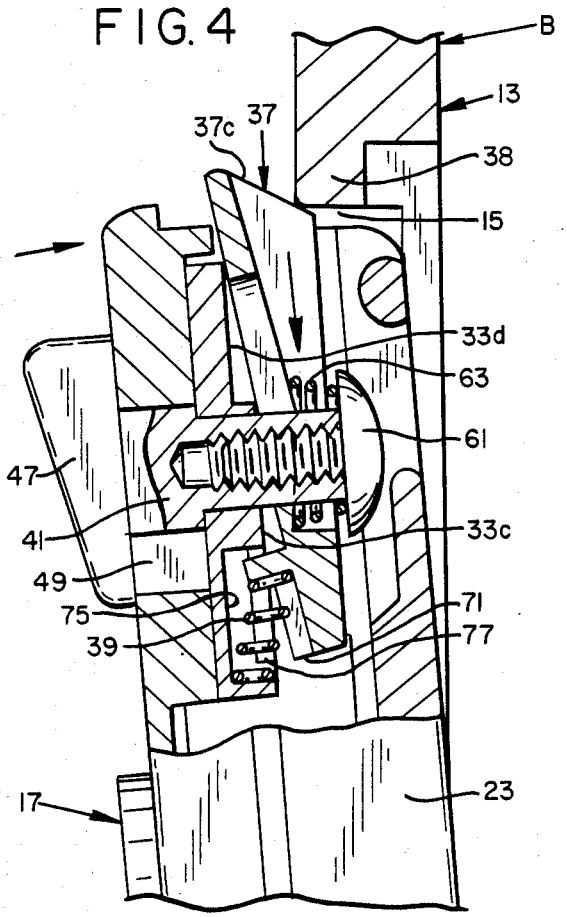
FIG. 4 is a similar view, but of FIG. 2.

It is evident from FIGS. 3 and 4 that there is sufficient space between the face 33*c* and the head 61 as to permit the latch bolt to tilt from the FIG. 3 position to the FIG. 4 position.

The latch bolt at its lower portion has a pair of stops 71 (compare FIGS. 4 and 5) which at their upper ends flank a guide element 73 designed to fit in a channel 75 (FIG. 5) formed in the yoke 33.

In the closed position of the door, the lower edges of the stops 71 are disposed just above stop shoulders 77 (FIG. 5) formed on the yoke 33.

Thus, in the closed position of the door, if the lock box is struck in a downward direction against an abutment in an attempt to cause the latch bolt 37, under inertial forces, to move downwardly to an unlocking position, the stop elements 71 come into immediate contact with the stop shoulders 77 and prohibit downward releasing movement of the latch bolt.

However, when the door D is moved to its open position, at a time when the combination wheels are turned to permit downward releasing movement of the release shaft, and thus of the yoke 33 and latch bolt 37, the door must be subsequently closed, after usage of the stored key (not shown) is over. In order to achieve automatic retracting movement of the latch bolt 37, the door has been designed so that there is sufficient space between the recessed face 33*d* of the yoke and the screw head 61 to permit camming edges 37*c* on the bolt, when they come into contact with flange 38, to cause the latch bolt to tilt to the FIG. 4 position, where the stop elements 71 are moved to a position out of register with the stop shoulders 77. This permits the camming contact of the latch bolt 37 with the flange 38 to cam the latch bolt in a retracting, downward direction so that it automatically moves under the flange 38. Once clear of the flange 38, the latch bolt 37 is forced upward into its locked position behind flange 38 by the coil springs 39 which are contained between the guide lug 73 (FIGS. 3 and 5) and a shelf 81 formed on the yoke 33. At the same time, the coil spring at 63 will urge the tilt bolt to return to its normal position, shown in FIG. 3, with the stop elements 71 returning to a position registering with the stop shoulder 77.

What is claimed is:

1. In a lock structure:

a first member, a second member, a latch member carried by said first member and having a latching relationship with respect to said second member, said first member being movable from a piston where said latch member is in its latching position to a second position where said latch member is in an unlatching position, said latch member and said second member having a camming relationship such that relative approaching movement of the two would cause the latch member to move in an unlatching direction, first stop means cooperable with said first member and having releasing and non-releasing positions and preventing movement of said first member relative to said second member except when said stop means is in its releasing position, second stop means cooperable with said latch member and having releasing and non-releasing positions and preventing unlatching movement of said latch member relative to said first member except when said second stop means is in its releasing position.

2. A lock structure as recited in claim 1 in which said second stop means includes stop elements on said first member and on said latch member normally disposed in a substantially abutting relationship, and means mounting said latch member for tilting movement relative to said first member to dispose said stop elements in a non-abutting relationship for permitting unlatching movement of said latch member relative to said first member.

3. A lock structure as recited in claim 2 in which said second member provides an opening, a third member constituting a door for said opening and movably carrying said first member.

4. A lock structure as recited in claim 3 in which the first stop means includes a combination lock and said first member comprises a slide yoke cooperatively related to said combintion lock and movable in an unlatching direction only when the proper combination has been entered into said combination lock.

5. A lock structure as recited in claim 2 in which spring means are provided for urging said latch member against tilting movement, second spring means urging said latch member to a locking position.

* * * * *

UNITED STATES PATENT AND TRADEMARK OFFICE

CERTIFICATE OF CORRECTION

PATENT NO. : 4,626,007

DATED : December 2, 1986

INVENTOR(S) : WAYNE F. LARSON

It is certified that error appears in the above-identified patent and that said Letters Patent is hereby corrected as shown below:

In the Specification:

Col. 1, line 19: "adsolutely" should be --absolutely--.

Col. 2, line 52: "and" should be --end--.

In the Claims:

Col. 3, line 41: "piston" should be --position--.

Col. 4, line 34: "combintion" should be --combination--.

Signed and Sealed this

Third Day of March, 1987

*Attest:*

*Attesting Officer*

DONALD J. QUIGG

*Commissioner of Patents and Trademarks*